US007020417B2

(12) United States Patent
Nomura et al.

(10) Patent No.: US 7,020,417 B2
(45) Date of Patent: Mar. 28, 2006

(54) IMAGE CARRIER CARTRIDGE, AN EXPOSURE HEAD SHIELDED FROM LIGHT, AND IMAGE FORMING APPARATUS USING THESE

(75) Inventors: Yujiro Nomura, Nagano-Ken (JP); Atsunori Kitazawa, Nagano-Ken (JP); Kiyoshi Tsujino, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/634,916

(22) Filed: Aug. 6, 2003

(65) Prior Publication Data

US 2004/0101327 A1 May 27, 2004

(30) Foreign Application Priority Data

Aug. 6, 2002 (JP) ..... 2002-228309
Aug. 12, 2002 (JP) ..... 2002-234503

(51) Int. Cl.
*G03G 21/18* (2006.01)

(52) U.S. Cl. ..... 399/111; 399/118

(58) Field of Classification Search ..... 399/111, 399/110, 118, 119
See application file for complete search history.

(56) References Cited

U.S. PATENT DOCUMENTS 5,808,649 A 9/1998 Shimanari et al.
6,034,712 A 3/2000 Iwasaki
6,266,074 B1 7/2001 Koumura et al.
6,453,135 B1 * 9/2002 Sameshima et al. ..... 399/110

FOREIGN PATENT DOCUMENTS

EP 2000-238333 9/2000
JP 06167845 A * 6/1994
JP 11-138899 A 5/1999
JP 2000238317 A * 9/2000
JP 2002-019176 A 1/2002
JP 2002-023593 A 1/2002

* cited by examiner

*Primary Examiner*—Quana Grainger

(57) ABSTRACT

An image carrier cartridge 25 comprises at least one image carrier 20 rotatably supported and exposure means 23 disposed at an exposure position for the image carrier 20 and the image carrier cartridge 25 is designed to be detachable relative to the body of an image forming apparatus. The exposure means 23 comprises an organic EL light emitting element array and an imaging optical system disposed in front of the organic EL light emitting element array, and a light shielding member 52, 53 for shielding ultraviolet rays is provided around the exposure means 23. According to this structure, in the image carrier cartridge to which organic EL array exposure heads as the exposure means are attached, the organic EL array exposure heads can be prevented from being deteriorated due to ultraviolet rays.

18 Claims, 15 Drawing Sheets

IMAGE CARRIER CARTRIDGE, AN EXPOSURE HEAD SHIELDED FROM LIGHT, AND IMAGE FORMING APPARATUS USING THESE

BACKGROUND OF THE INVENTION

The present invention relates to an image carrier cartridge, an exposure head, and an image forming apparatus using these and, more particularly, to an image carrier cartridge with which an organic EL array exposure head as exposure means is united and an image forming apparatus which can be designed to be compact by employing the image carrier cartridge.

In conventional image forming apparatus, such as copying machines, printers, and facsimile machines, utilizing electrophotographic technology, it is common practice to employ a laser scanning optical system as writing means. Under such circumstances, an image forming apparatus has been proposed in Japanese Patent Unexamined Publication No. 2002-23593, in which an EL array exposure head is positioned and arranged in an image carrier cartridge, thereby improving the accuracy in positioning of the EL array exposure head relative to the image carrier. In Japanese Patent Unexamined Publication No. H11-138899, an exposure head has been proposed which employs a single chip on which organic EL light emitting elements are integrated, thereby eliminating variation in light emitting characteristics and reducing the cost. It has been proposed in Japanese Patent Unexamined Publication No. 2002-19176 to hold organic EL light emitting elements and rod lens arrays by a cover preventing the leakage of light.

By the way, in case of employing an organic EL array as writing means of an image forming apparatus, light-emitting parts and driving parts can be disposed together on a single substrate. Therefore, as compared to LED array, higher positioning accuracy of elements and small width between elements can be obtained. However, the organic EL light emitting elements are susceptible to ultraviolet light and thus deteriorated so that the light emitting amount and the light emitting efficiency of the elements are reduced. Especially in case that an organic EL array exposure head is mounted to an image carrier cartridge, the organic EL array exposure head is moved outside of the apparatus and is exposed to outside light together with the image carrier cartridge during replacement of the image carrier cartridge or process for removing a jammed paper. During this, ultraviolet rays from fluorescent lights and/or sunlight are incident on organic EL light emitting material of the organic EL array exposure head so that the organic EL light emitting element(s) may be deteriorated. The deterioration of the organic EL light emitting element(s) leads to reduction in light emitting amount of the deteriorated element(s) and variation in light emitting amount among elements, thus deteriorating the quality of printed image or character.

FIG. 15 is an explanatory illustration showing a course example of light beams emitted from an organic EL light emitting element. In FIG. 15, light beams emitted from the organic EL light emitting element 90 is incident on a transparent substrate 91 so that projected light Rp is projected from a surface opposite to the surface on which the organic EL light emitting element 90 is disposed. Numerals 92, 93 designate frame parts arranged on end faces in the longitudinal direction of the transparent substrate 91. When light beams are projected from the transparent substrate 91, light beams of which incident angle relative to the projection surface exceeds the critical angle are reflected totally at the projection surface. Most of the light beams reflected totally once are projected through the end faces of the transparent substrate 91 after being repeatedly reflected in the transparent substrate 91. The light beams projected through the end faces are stray light beams Rt in the exposure head. Some stray light beams Rt pass an optical system to expose undesired portions on image surface, thus deteriorating the image quality.

To drive the organic EL light emitting element 90, a TFT (thin film transistor) formed on the transparent substrate 91 is employed. The TFT has such a feature that its electrical characteristic varies as light is incident on the TFT. Therefore, if a light beam projected through the end face of the transparent substrate 91 is incident on the TFT as a re-incident light beam Rs, the condition of driving the EL light emitting element 90 is changed, thus unsettling the light emitting amount.

SUMMERY OF THE INVENTION

The present invention has been made in consideration of these problems of the prior arts. Therefore, it is an object of the present invention to prevent organic EL array exposure heads from being deteriorated due to ultraviolet rays in an image carrier cartridge to which the organic EL array exposure heads as exposure means are attached. It is another object to prevent the leakage of stray light from a transparent substrate on which organic EL light emitting elements are mounted and prevent the re-incident of light onto the transparent substrate in an exposure head.

An image carrier cartridge of the present invention achieving the aforementioned object comprises: at least one image carrier rotatably supported and exposure means disposed at an exposure position for said image carrier, said image carrier cartridge being designed to be detachable relative to the body of an image forming apparatus, wherein said exposure means comprises an organic EL light emitting element array and an imaging optical system disposed in front of the organic EL light emitting element array, and a light shielding member for shielding at least ultraviolet rays is provided around said exposure means.

In this case, the light shielding member preferably has a first light shielding member disposed to cover the organic EL light emitting element array.

Further, the light shielding member preferably has a second light shielding member disposed to cover a part of the image carrier near the exposure means so as to prevent ultraviolet rays from being incident on the exposure position of the image carrier.

In this case, it is preferable that a developing means to be disposed at a developing position for the image carrier is detachable relative to the image carrier cartridge, and the second light shielding member is disposed between a position, where the developing means is allowed to be in contact with the image carrier, and the exposure means.

Further, a cleaning means is preferably provided for cleaning a face, confronting the image carrier, of the imaging optical system.

Furthermore, an ultraviolet cutting member for cutting out ultraviolet rays is preferably provided on or near the face, confronting the image carrier, of the imaging optical system.

In this case, it is preferable that the ultraviolet cutting member is provided on a sliding member which is slidable along the face, confronting the image carrier, of the imaging optical system and a cleaning member is provided in such a manner as to touch the ultraviolet cutting member during sliding operation.

In addition, the image carrier cartridge may comprise a plurality of the image carriers and a plurality of the exposure means corresponding to the respective image carriers.

The present invention includes an image forming apparatus which employs an image carrier cartridge of the present invention as mentioned above, and comprises a charging means, an exposure means, a developing means, and a transfer means which are arranged around the image carrier, wherein the image forming apparatus transfers a toner image formed on the image carrier onto a transfer medium.

In the present invention, the exposure means comprises an organic EL light emitting element array and an imaging optical system disposed in front of the organic EL light emitting element array and a light shielding member for shielding at least ultraviolet rays is provided around the exposure means, whereby even when the image carrier cartridge is detached from the body of the image forming apparatus for the purpose of replacement of expendable supplies or process for removing a jammed paper so that the image carrier cartridge is exposed to ultraviolet rays from fluorescent lights and/or sunlight, the light shielding member can prevents the ultraviolet rays from reaching the light emitting parts of the organic EL light emitting element array, thereby preventing the organic EL light emitting element from being deteriorated due to the ultraviolet rays.

An exposure head of the present invention achieving the aforementioned object is an exposure head to be disposed at an exposure position for an image carrier, said exposure head comprising at least a transparent substrate, an organic EL light emitting element array having light emitting parts formed on said transparent substrate and aligned in lines, and an imaging optical system disposed in front of said organic EL light emitting element array, wherein light beams outputted from said light emitting parts pass through said transparent substrate and are projected toward said image carrier, said transparent substrate has surfaces being in parallel to each other, one of the surfaces being a surface on which said light emitting parts are formed and the other being a surface from which said light beams are projected, a member covering said transparent substrate is an opaque member, and all of faces of said opaque member confronting the end faces of said transparent substrate are composed of light absorbing members. With this structure, the leakage of stray light from the glass substrate to the outside of the optical system can be prevented and light once projected through end faces of the glass substrate can be prevented from being incident on the glass substrate again. Therefore, the variation in light emitting amount among the organic EL light emitting elements is prevented and deterioration of image quality is also prevented.

Further, the present invention is characterized in that the light absorptance of said light absorbing member is set to be larger than the light absorptance of said transparent substrate and to be not larger than 0.5. According to this structure, the amount of light absorbed by the light absorbing member is increased, thus effectively absorbing the stray light and the re-incident light.

Furthermore, the present invention is characterized in that said light absorbing member is black. Since the light absorbing member has light absorbing property relative to light beams of all wavelengths, the light absorbing member can absorb light regardless of the wavelength of light emitted by the organic EL light emitting elements.

Still further, the present invention is characterized in that said transparent substrate is optically sealed by said opaque member. Therefore, the total internal reflection at the end faces of the transparent substrate is prevented, thereby effectively absorbing light.

Moreover, the present invention is characterized in that TFTs for driving said light emitting parts are formed on said transparent substrate. Therefore, the condition of driving the EL light emitting element never be changed, thereby preventing the light emitting amount from being unsettled.

In addition, an image forming apparatus of the present invention is characterized by employing an image carrier cartridge to which an exposure head as mentioned above is attached. The image forming apparatus comprises a charging means, the exposure means, a developing means, and a transfer means which are arranged around the image carrier, wherein said image forming apparatus transfers a toner image formed on said image carrier onto a transfer medium. It is possible to provide an image forming apparatus without image quality deterioration.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
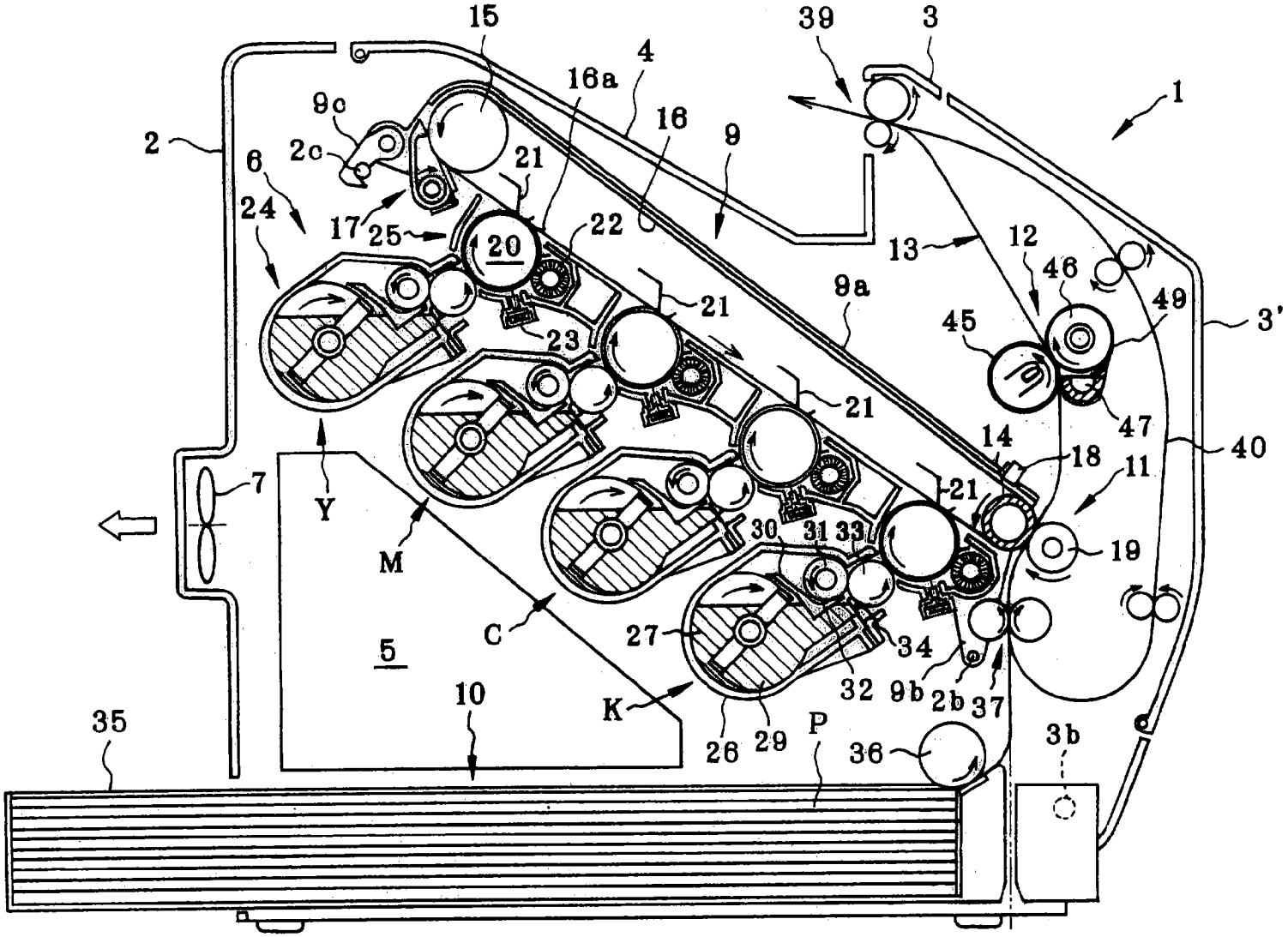
FIG. 1 is a schematic sectional view showing the entire structure of an embodiment of the image forming apparatus of the present invention.

Hereinafter, embodiments of an image forming apparatus and an image carrier cartridge to be used in the apparatus according to the present invention will be described with reference to the attached drawings. FIG. 1 is a schematic sectional view showing the entire structure of an embodiment of an image forming apparatus of the present invention. This embodiment is of a type employing an intermediate transfer belt as a transfer belt.

In FIG. 1, the image forming apparatus 1 of this embodiment comprises a housing body 2, a first door member 3 which is disposed on the front of the housing body 2 such that the first door member is openable and closable, and a second door member (also functioning as an outfeed tray) 4 which is disposed on the top of the housing body 2 such that the second door member is openable and closable. The first door member 3 is provided with a lid 3' which is disposed such that the lid 3' is openable and closable relative to the front of the housing body 2. The lid 3' can be opened and closed in conjunction with or independently from the first door member 3. Disposed in the housing body 2 are an electrical component box 5 in which substrates for power source circuits and substrates for control circuits are housed, an image forming unit 6, a blower fan 7, a transfer belt unit 9, and a paper feeding unit 10. Disposed in the first door member 3 are a secondary transfer unit 11, a fixing unit 12, and a recording medium carrying means 13. Expendable supplies in the image forming unit 6 and the paper feeding unit 10 are detachable relative to the body. In this case, as the transfer belt unit 9 is detached together with the expendable supplies, the maintenance and replacement are allowed. The housing body 2 has two pairs of pivotal shafts 3*b* which are disposed on both sides of a lower front surface of the housing body 2, respectively. The first door member 3 is attached to the lower front portion of the housing body 2 via the pivotal shafts 3*b* so that the first door member 3 is openable and closable.

In this embodiment, as will be described later, the respective units can be attached to and detached from the apparatus only by access from the front of the apparatus. This allows the apparatus to be placed in a narrow space. In FIG. 1, the transfer belt unit 9 comprises a driving roller 14 which is disposed in a lower portion of the housing body 2 and is driven by a driving means (not shown) to rotate, a driven roller 15 which is disposed diagonally above the driving roller 14, an intermediate transfer belt 16 which is laid around the two rollers 14, 15 with some tension and is driven to circulate in a direction indicated by an arrow, and a cleaning means 17 which abuts on the surface of the intermediate transfer belt 16. The driven roller 15 and the intermediate transfer belt 16 are arranged obliquely to the upper left of the driving roller 14 in the drawing. Accordingly, during the operation of the intermediate transfer belt 16, a belt face 16*a* of which traveling direction is downward takes a lower side. In this embodiment, the belt face 16*a* is a tension side (side tensioned by the driving roller 14) at the time of driving the intermediate transfer belt 16.

The driving roller 14 and the driven roller 15 are rotatably supported by a support frame 9*a* which has a pivotal portion 9*b* formed at a lower end thereof. The pivotal portion 9*b* is fitted to a pivot shaft 2*b* disposed in the housing body 2, whereby the support frame 9*a* is attached to the housing body 2 such that it is pivotally movable. In addition, the support frame 9*a* has a lock lever 9*c* which is rotatably disposed at an upper end thereof. The lock lever 9*c* can latch a latch pin 3*c* disposed on the housing body 2. The driving roller 14 also functions as a back-up roller for a secondary transfer roller 19 composing the secondary transfer unit 11. The driven roller 15 also functions as a back-up roller for the cleaning means 17. The cleaning means 17 is located at the belt face 16*a* side, of which traveling direction is downward.

On the back of the belt surface 16*a*, of which traveling direction is downward, of the intermediate transfer belt 16, primary transfer members 21 composed of leaf spring electrodes are disposed. The primary transfer members 21 are pressed into contact with the back of the intermediate transfer belt 16 by their elastic force at locations corresponding to image carriers 20 of respective image forming stations Y, M, C, and K, described later. A transfer bias is applied to each primary transfer member 21. In proximity to the driving roller 14, a test pattern sensor 18 is attached to the support frame 9*a* of the transfer belt unit 9. The test pattern sensor 18 is a sensor for positioning of toner images of respective colors on the intermediate transfer belt 16 and for compensating color registration error and densities of images of the respective colors by detecting image density of toner images of respective colors. The image forming unit 6 comprises the image forming stations Y (for yellow), M (for magenta), C (for cyan), and K (for black) for forming multi-color images (in this embodiment, four-color images). Each image forming station Y, M, C, K has an image carrier 20 composed of a photosensitive drum, a charging means 22, image writing means 23, and developing means 24 which are arranged around the image carrier 20.

Reference numerals for the charging means 22, the image writing means 23, and the developing means 24 of the image forming station Y are indicated on the drawings and the indication of the reference numerals for the other image forming stations is omitted because the image forming stations have the same structure. It should be understood that the image forming stations Y, M, C, K may be arranged in any order. The image forming stations Y, M, C, K are disposed such that the respective image carriers 20 are in contact with the belt face 16*a*, of which traveling direction is downward, of the intermediate transfer belt 16. As a result of this, the image forming stations Y, M, C, K are arranged in an obliquely leftward direction relative to the driving roller 14 in the drawing. Each image carrier 20 is driven to rotate in the traveling direction of the intermediate transfer belt 16 as indicated by arrows.

The charging means 22 is a conductive brush roller which is connected to a high-voltage source and rotates at a peripheral speed about twice to triple the speed of the image carrier 20 as a photoreceptor in opposite direction with being in contact with the surface of the image carrier 20 so as to uniformly charge the surface of the image carrier 20. In case of an image forming apparatus of a cleaner-less type just like this embodiment, it is preferable that a bias of the same polarity as the polarity of charged toner is applied to the brush roller during non image forming, whereby residual toner adhering to the brush roller is emitted to the image carrier 20, is transferred to the intermediate transfer belt 16 at the primary transfer portion, and is collected by the cleaning means 17 of the intermediate transfer belt 16. Since the charging means 22 enables charging of the surface of the image carrier with extremely small amount of electric current, the charging means never pollute inside and outside of the apparatus with large amount of ozone like in case of using a corona charging method. In addition, since the charging means 22 softly touch the image carrier 20, adhesion of toner remaining after transfer onto a charging roller which easily occurs in case of using a roller charging method hardly occurs, thereby ensuring the stability of the image quality and the reliability of the apparatus.

The image writing means 23 employs an organic EL array exposure head in which organic EL light emitting elements are aligned in line(s) in the axial direction of the image carrier 20. The organic EL array exposure head is more compact than a laser scanning optical system because of its short optical path length so that the organic EL array exposure head can be arranged in proximity to the image carrier 20, thereby miniaturizing the entire apparatus. In this embodiment, the image carrier 20, the charging means 22, and the image writing means 23 of each image forming station Y, M, C, K are united together into an image carrier unit 25 such that the image carrier unit 25 can be attached to and detached from the support frame 9*a* together with the transfer belt unit 9, thereby keeping the positions of the organic EL array exposure heads relative to the image carriers 20. When the image carrier unit 25 is replaced, the organic EL array exposure heads are also replaced together.

Then, details of the developing means 24 will be described by taking the image forming station K as an example. In this embodiment, since the image forming stations Y, M, C, K are obliquely arranged and the image carriers 20 are disposed to be in contact with the belt face 16*a*, of which traveling direction is downward, of the intermediate transfer belt 16, toner storage containers 26 are arranged obliquely downward to the lower left of the image carriers 20. For this, special structure is employed in the developing means 24. That is, the developing means 24 each comprises the toner storage container 26 storing toner (indicating by hatching), a toner storage area 27 formed in the toner storage container 26, a toner agitating member 29 disposed inside the toner storage area 27, a partition 30 defined in an upper portion of the toner storage area 27, a toner supply roller 31 disposed above the partition 30, a blade 32 attached to the partition 30 to abut the toner supply roller 31, the development roller 33 arranged to abut both the toner supply roller 31 and the image carrier 20, and a regulating blade 34 arranged to abut the development roller 33.

The image carrier 20 is rotated in the traveling direction of the intermediate transfer belt 16. The development roller 33 and the supply roller 31 are rotated in a direction opposite to the rotational direction of the image carrier 20 as shown by arrows. On the other hand, the agitating member 29 is rotated in a direction opposite to the rotational direction of the supply roller 31. Toner agitated and scooped up by the agitating member 29 in the toner storage area 27 is supplied to the toner supply roller 31 along the upper surface of the partition 30. Friction is caused between the toner and the blade 32 so that mechanical adhesive force and adhesive force by triboelectric charging are created relative to the rough surface of the supply roller 31. By these adhesive forces, the toner is supplied to the surface of the development roller 33. The toner supplied to the development roller 33 is regulated into a coating layer having a predetermined thickness by the regulating blade 34. The toner layer as a thin layer is carried to the image carrier 20 so as to develop a latent image on the image carrier 20 at and near a nip portion which is a contact portion between the development roller 33 and the image carrier 20.

In this embodiment, the development roller 33 disposed confronting the image carrier 20, the toner supply roller 31, and the contact portion of the regulating blade 34 relative to the development roller 33 are not submerged in the toner in the toner storage area 27. This arrangement can prevent the contact pressure of the regulating blade 34 relative to the development roller 33 from being varied due to the decrease of the stored toner. In addition, since excess toner scraped from the development roller 33 by the regulating blade 34 spills onto the toner storage area 27, thereby preventing filming of the development roller 33. The contact portion between the development roller 33 and the regulating blade 34 is positioned below the contact portion between the supply roller 31 and the development roller 33. There is a passage for returning excess toner, which was supplied to the development roller 33 by the supply roller 31 but not transmitted to the development roller 33, and excess toner, which was removed from the development roller 33 by the regulating operation of the regulating blade 34, to the toner storage area 27 at the lower portion of the developing means. The toner returned to the toner storage area 27 is agitated with toner in the toner storage area 27 by the agitating member 29, and is supplied to a toner inlet near the supply roller 31 again. Therefore, the excess toner is let down to the lower portion without clogging the friction portion between the supply roller. 31 and the development roller 33 and the contact portion between the development roller 33 and the regulating blade 34 and is then agitated with toner in the toner storage area 27, whereby the toner in the developing means deteriorates slowly so that portentous changes in image quality just after the replacement of the developing means is prevented.

The sheet supply unit 10 comprises a sheet cassette 35 in which a pile of recording media P are held, and a pick-up roller 36 for feeding the recording media P from the sheet cassette 35 one by one. The sheet cassette 35 and the pick-up roller 36 compose a paper feeding portion. Arranged inside the first door member 3 are a pair of resist rollers 37 for regulating the feeding of a receiving medium P to the secondary transfer portion at the right time, a secondary transfer unit 11 as a secondary transfer means abutting on and pressed against the driving roller 14 and the intermediate transfer belt 16, a fixing unit 12, the recording medium carrying means 13, a pair of outfeed rollers 39, and a dual-side printing passage 40.

The fixing unit 12 comprises a fuser roller 45 which has a built-in heating element such as a halogen heater and which is freely rotatable, a pressure roller 46 pressing the fuser roller 45, a belt tensioning member 47 which is disposed to freely swing relative to the pressure roller 46, and a heat resistant belt 49 which is lied around the pressure roller 45 and the belt tensioning member 47. A color image secondarily transferred to a recording medium is fixed to the recording medium at the nip portion formed between the fuser roller 45 and the heat resistant belt 49 at a predetermined temperature. In this embodiment, the fixing unit 12 can be arranged in a space formed obliquely upward the intermediate transfer belt 16, that is, a space formed on the opposite side of the image forming unit 6 relative to the intermediate transfer belt 16. This arrangement enables the reduction in heat transfer to the electrical component box 5, the image forming unit 6, and the intermediate transfer belt 16, and lessens the frequency of taking the action for correcting color registration error.

The actions of the image forming apparatus as a whole will be summarized as follows:

(1) As a printing command (image forming signal) is inputted into the control circuit(s) in the electric component box 5 from a host computer (personal computer) (not shown) or the like, the image carriers 20 and the respective rollers of the developing means 24 of the respective image forming stations Y, M, C, K, and the intermediate transfer belt 16 are driven to rotate.

(2) The outer surfaces of the image carriers 20 are uniformly charged by the charging means 22.

(3) In the respective image forming stations Y, M, C, K, the outer surfaces of the image carriers 20 are exposed to selective light corresponding to image information for respective colors by the image writing means 23, thereby forming electrostatic latent images for the respective colors.

(4) The electrostatic latent images formed on the image carriers 20 are developed by the developing means 24 to form toner images.

(5) The primary transfer voltage of the polarity opposite to the polarity of the toner is applied to the primary transfer members 21 of the intermediate transfer belt 16, thereby transferring the toner images formed on the image carriers 20 onto the intermediate transfer belt 16 one by one at the primary transfer portions. According to the movement of the intermediate transfer belt 16, the toner images are superposed on the intermediate transfer belt 16.

(6) In synchronization with the movement of the intermediate transfer belt 16 on which primary images are primarily transferred, a receiving medium P accommodated in the sheet cassette 35 is fed to the secondary transfer roller 19 through the pair of resist rollers 37.

(7) The primary-transferred image meets with the receiving medium at the secondary transfer portion. A bias of the polarity opposite to the polarity of the primary-transferred image is applied by the secondary transfer roller 19 which is pressed against the driving roller 14 for the intermediate transfer belt 16 by the pressing mechanism, whereby the primary-transferred image is secondarily transferred to the receiving medium fed in the synchronization manner.

(8) Residual toner after the secondary transfer is carried toward the driven roller 15 and is scraped by the cleaning means 17 disposed opposite to the roller 15 so as to refresh the intermediate transfer belt 16 to allow the above cycle to be repeated.

(9) The receiving medium passes through the fixing means 12, whereby the toner image on the receiving medium is fixed. After that, the receiving medium is carried toward a predetermined position (toward the outfeed tray 4 in case of single-side printing, or toward the dual-side printing passage 40 in case of dual-side printing).

Figure 2:
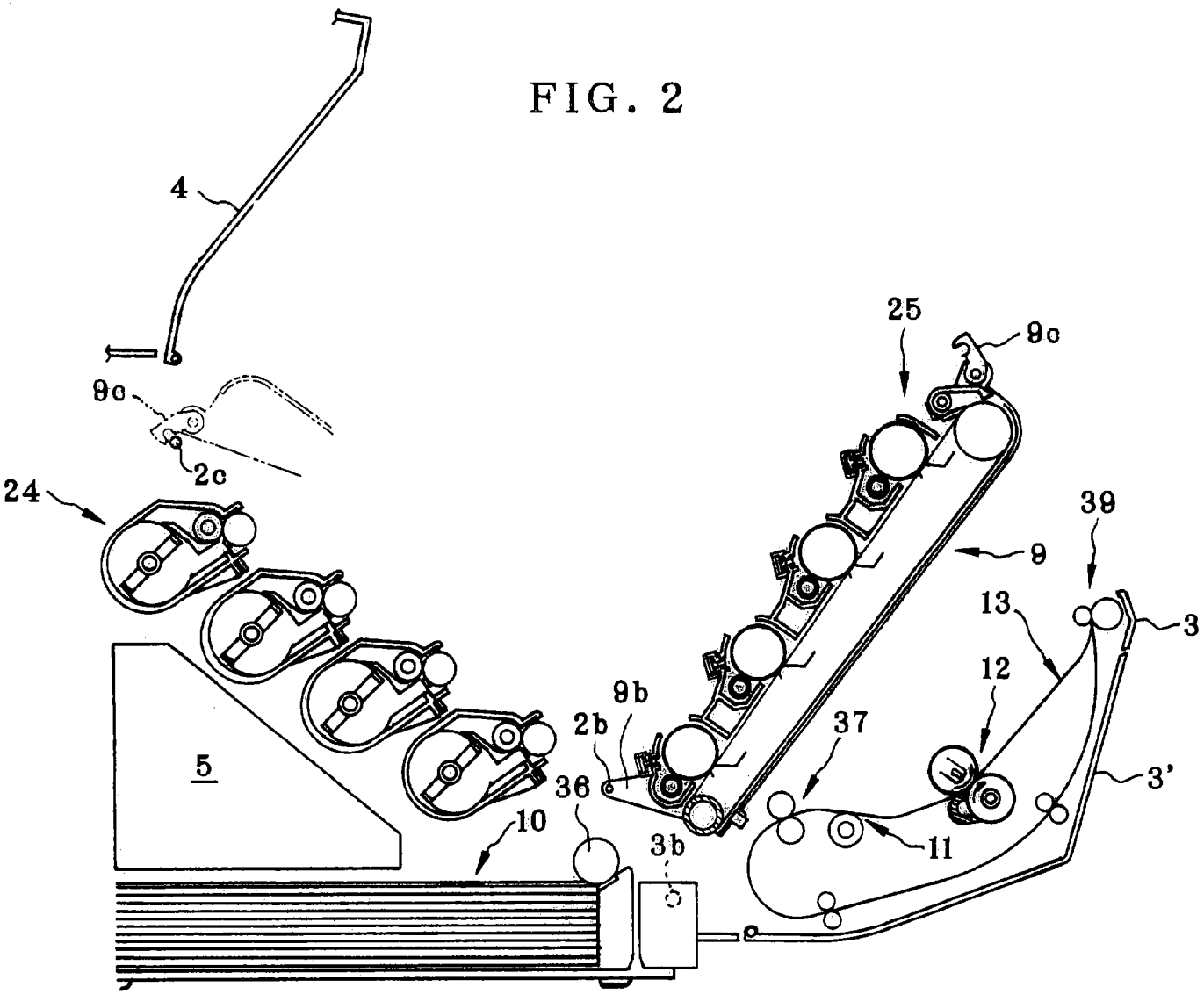
FIG. 2 is an illustration showing the apparatus shown in FIG. 1 in a state that a fixing unit, a secondary transfer unit, a transfer belt unit, an image carrier unit, and a developing means are exposed.
Figure 3:
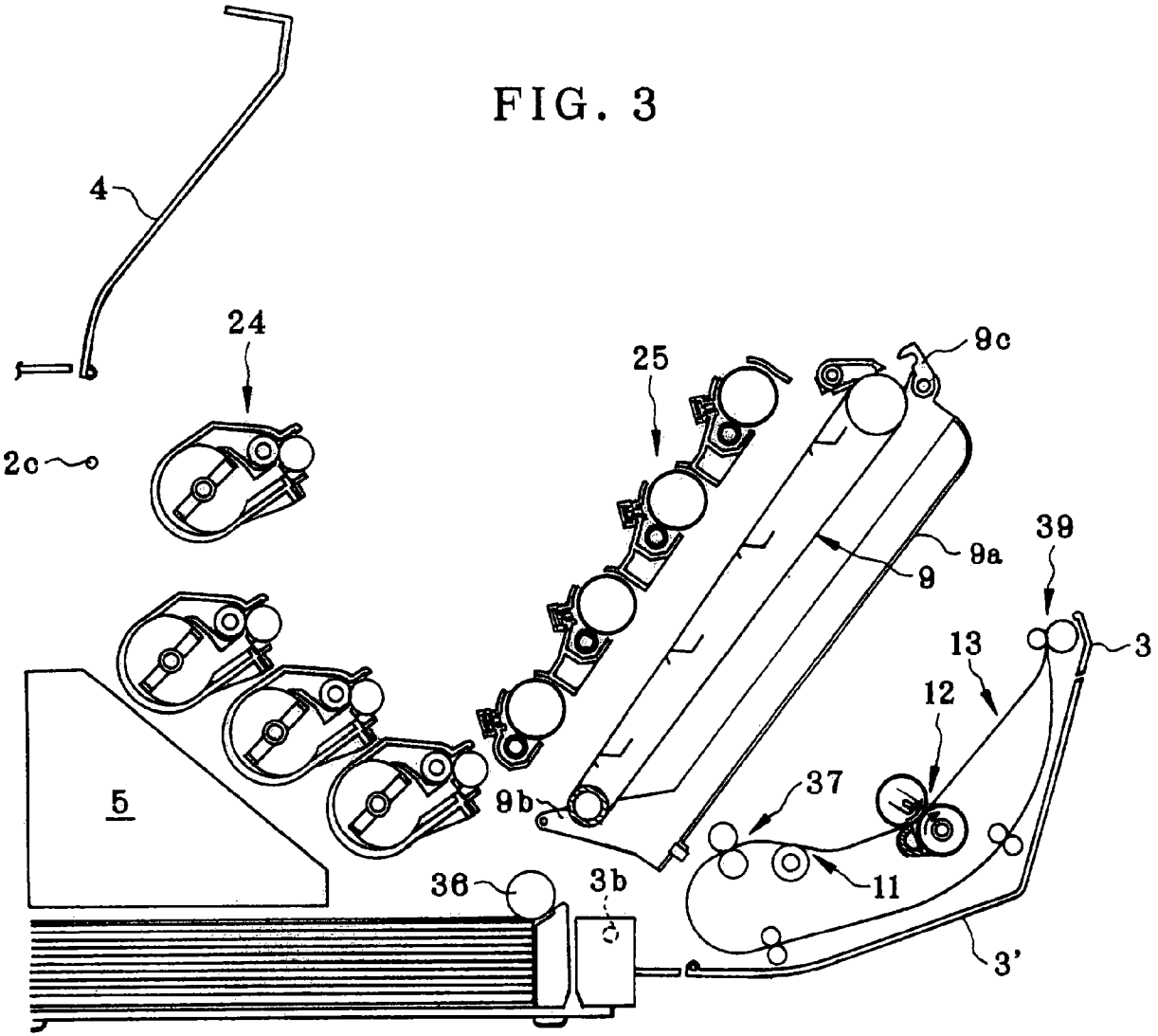
FIG. 3 is an illustration showing the apparatus in a state that the image carrier unit and the transfer belt unit are detached for replacement further from the state shown in FIG. 2.

Now, with reference to FIG. 2 and FIG. 3, the replacement of the expendable supplies and the removal of a jammed recording medium will be described. FIG. 2 shows a state that the first door member 3 is pivotally moved downwards about the pivotal shafts 3*b* together with the lid 3' to expose the fixing unit 12 and the secondary transfer unit 11. In addition, the lock lever 9*c* provided on the top of the frame 9*a* of the transfer belt unit 9 is pivotally moved to disengage itself from the latch pin 3*c* and the frame 9*a* is pivotally moved to the right about the pivot shaft 2*b* so as to expose the transfer belt unit 9 and the image carrier unit 25 which are supported by the frame 9*a*. The developing means 24 supported on the housing body 2 side can be exposed by the aforementioned operation. In this state, as shown in FIG. 3, the image carrier unit 25 and the transfer belt unit 9 can be detached from the frame 9*a* for replacement. In addition, the developing means 24 can be also independently and selectively replaced. Moreover, it is possible to remove recording media jammed within a feeding passage.

Figure 4:
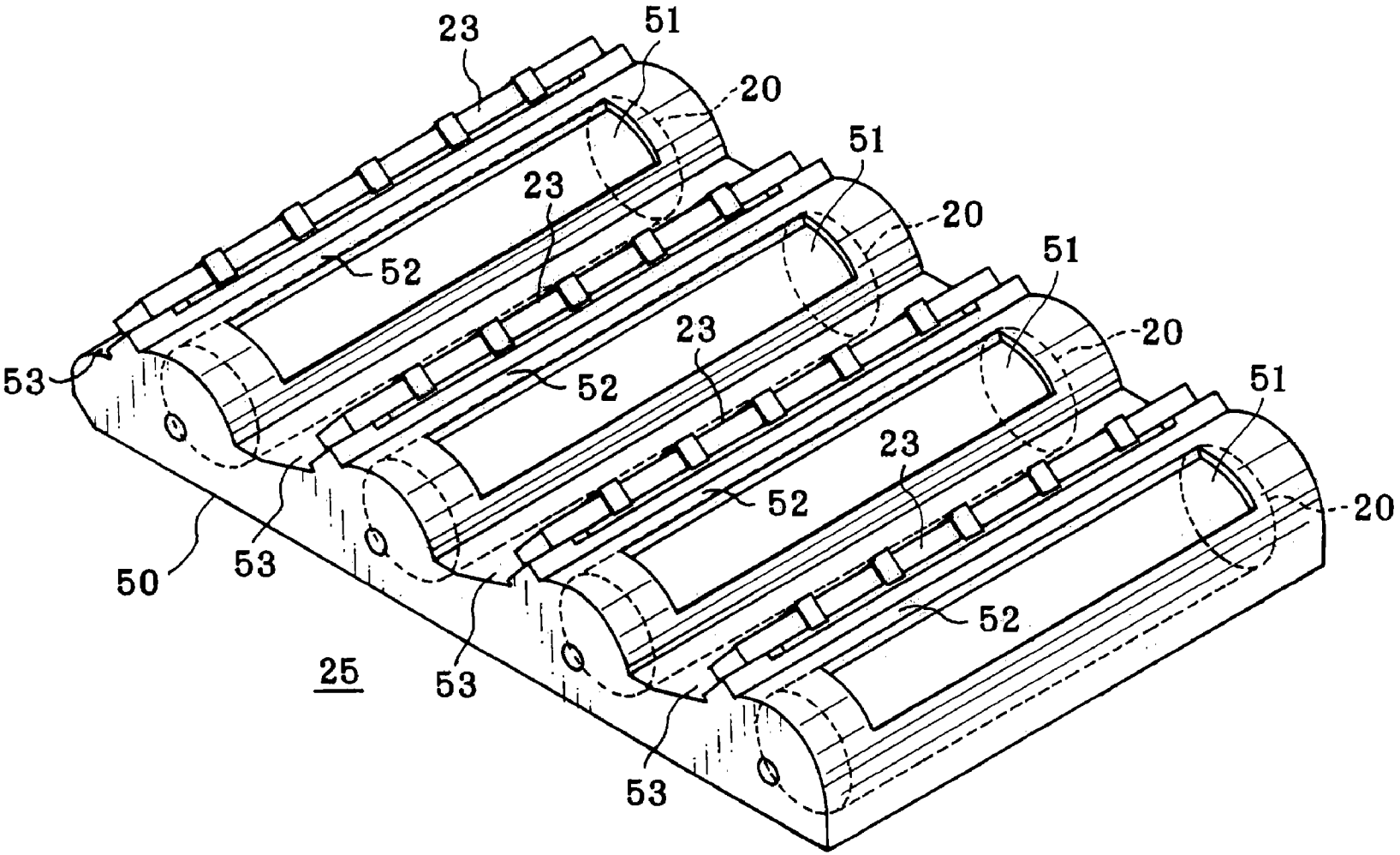
FIG. 4 is a perspective view of the image carrier unit to be used in the apparatus shown in FIG. 1 as seen from the developing means side.
Figure 5:
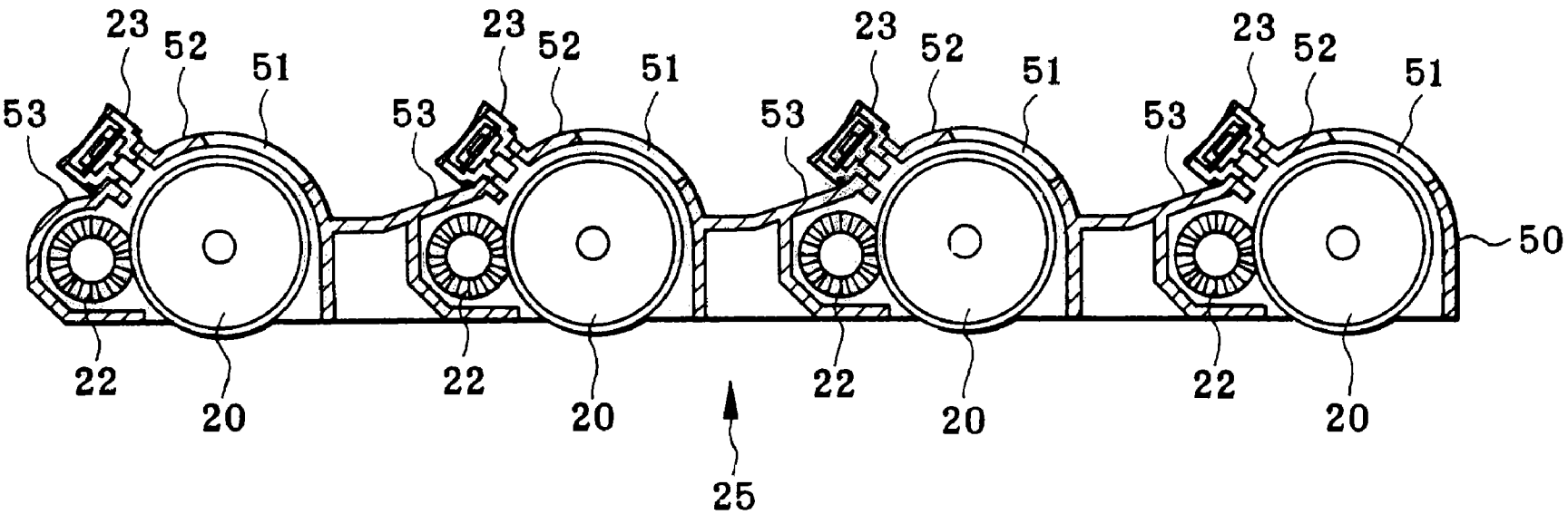
FIG. 5 is a sectional view of the image carrier unit shown in FIG. 4.

Hereinafter, an image carrier unit (image carrier cartridge) 25 according to an embodiment of the present invention in which the image carriers 20, the charging means 22, and the image writing means 23 of the respective image forming stations Y, M, C, and K are united together will be described with reference to FIG. 4 through FIG. 8. FIG. 4 is a perspective view of the image carrier unit 25 as seen from the developing means 24 side and FIG. 5 is a sectional view of the image carrier unit. The image carrier unit 25 comprises a casing 50 made of an opaque metallic plate or the like and having openings on a side confronting the intermediate transfer belt 16. In the casing 50, four image carriers (photosensitive drums) 20 of the image forming stations Y, M, C, and K are rotatably supported parallel to each other at certain intervals, conductive brush rollers as the charging means 22 are supported such that each charging means 22 rotates with being in contact with a predetermined position of each image carrier 20, organic EL array exposure heads as the image writing means 23 are positioned relative to the image carriers 20 and parallel to the image carriers 20 on downstream side than the charging means 22. Openings 51 are formed in the wail of the casing 50 on downstream side than the image writing means 23 so as to allow the developing rollers 33 of the developing means 24 to be in contact with the image carriers 20, respectively. Between each opening 51 and each image writing means 23, a shielding portion 52 of the casing 50 remains. Between each charging means 22 and each image writing means 23, a shielding portion 53 of the casing 50 remains. As will be described later, the shielding portions 52, 53, particularly the shielding portion 52 between the opening 51 and the image writing means 23, prevent ultraviolet rays from reaching the light emitting parts made of organic EL material from outside.

Figure 6:
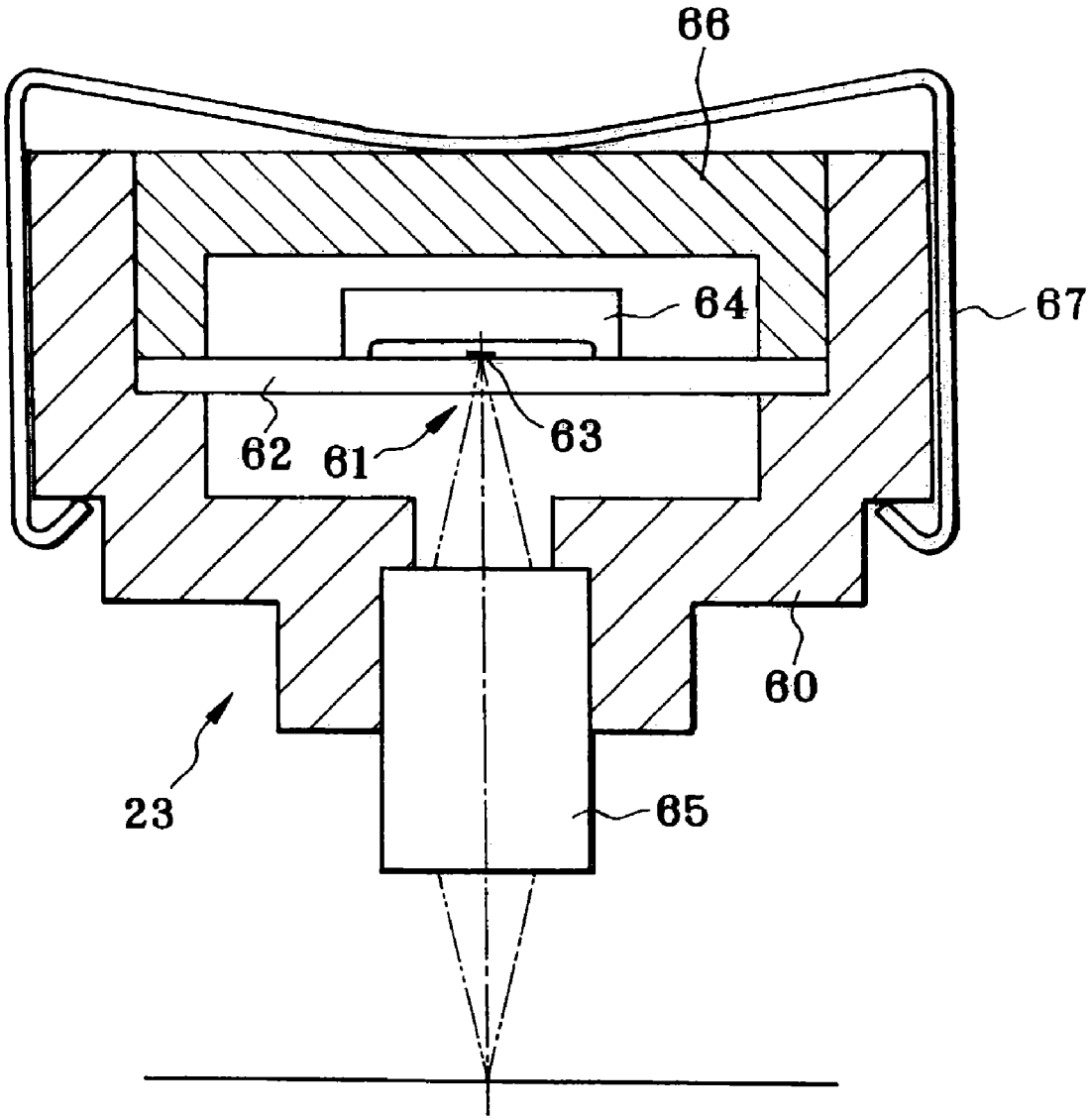
FIG. 6 is a sectional view showing an image writing means to be used in the image carrier unit shown in FIG. 4.

FIG. 6 is a sectional view of one of the image writing means 23. The image writing means 23 comprises an opaque housing 60 having a gradient index type rod lens array 65 which is composed of gradient index type rod lenses 65' (FIG. 8) aligned in zigzag fashion and is disposed on the central portion to face the image carrier 20 to allow the passage of light inside and outside, an organic EL light emitting element array 61 mounted in the housing to face the back of the gradient index type rod lens array 65, and an opaque cover 66 for shielding the organic EL light emitting element array 61 from the back of the housing 60. The cover 66 is pressed against the back of the housing 60 by a tie spring 67 so as to optically seal the inside of the housing 60. The housing 60 encloses the glass substrate 62 and opens the side confronting the image carrier 20. With this structure, light rays are incident on the image carrier 20 from the gradient index type rod lenses 65'. A light absorbing member (paint) is provided on surfaces of the housing 60 confronting the ends of the grass substrate 62.

Figure 7:
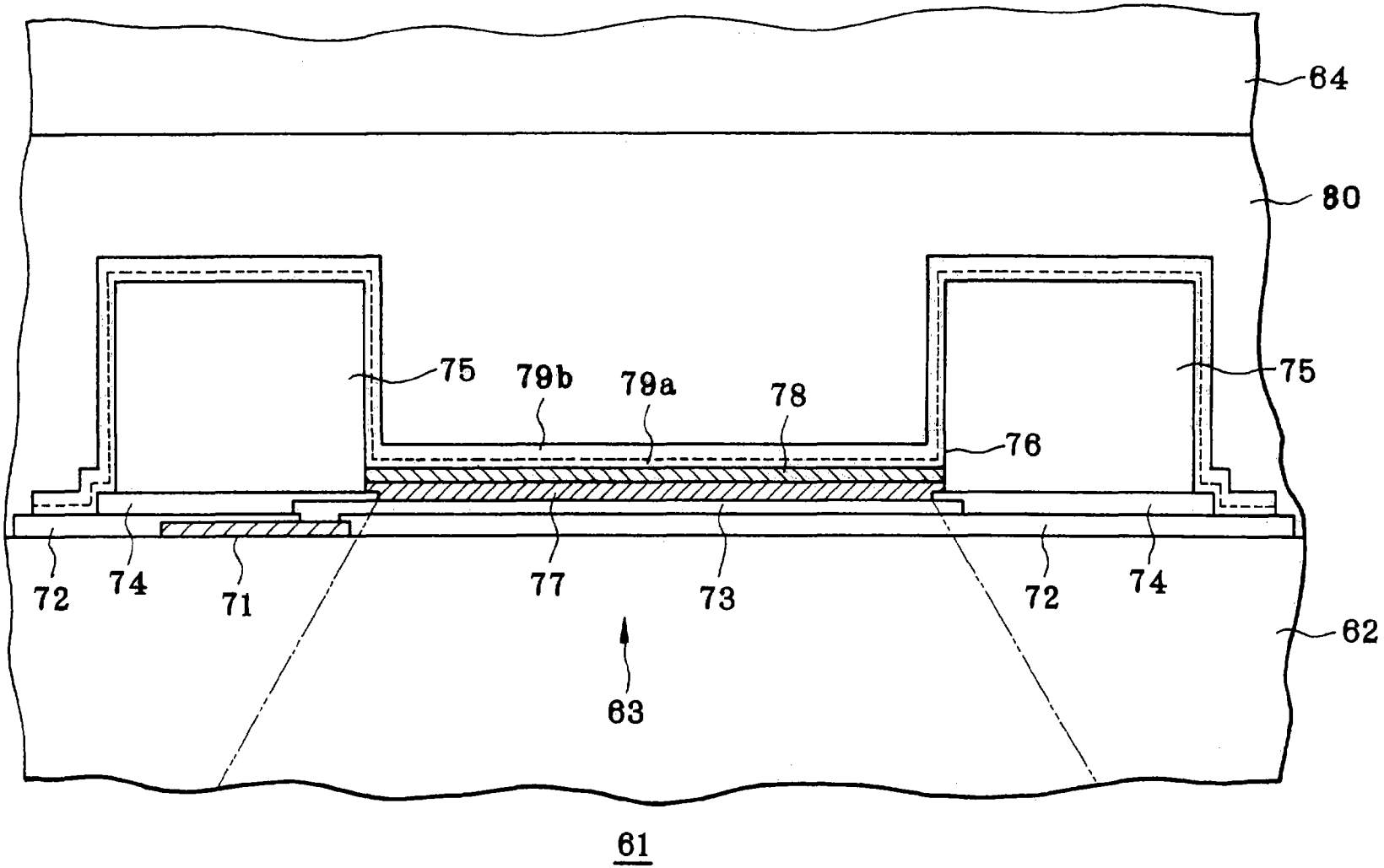
FIG. 7 is a sectional view showing an example of a portion near a light emitting part of an organic EL light emitting element array of the image writing means shown in FIG. 6.

FIG. 7 is a sectional view showing an example of a portion near a light emitting part 63 of the organic EL light emitting element array 61 of the image writing means 23 shown in FIG. 6. The organic EL light emitting element array 61 comprises a glass substrate 62, for example, 0.5 mm in thickness, and TFTs (thin film transistors) 71 each of which controls the light emission of each light emitting part 63 and is made of polysilicon to have a thickness of 50 nm. The TFTs 71 are provided corresponding to the light emitting parts 63, respectively, which are aligned in two lines in zigzag fashion, at positions out of the light emitting parts 63. Formed on the glass substrate 62 except contact holes above the TFTs 71 is an insulating film 72 made of $SiO_2$ to have a thickness of about 100 nm. Positive electrodes 73 having a thickness of 150 nm made of ITO are formed on portions corresponding to the light emitting parts 63 in such a manner that the positive electrode 73 can be in contact with the TFT 71 through the contact hole. Then, another insulating film 74 made of $SiO_2$ having a thickness of about 120 nm is formed on portions corresponding to positions other than the light emitting parts 63. Formed on the insulating films 74 are banks 75 made of polyimide having a thickness of 2 μm and having holes 76 which are formed corresponding to the light emitting parts 63. In each of the holes 76 of the banks 75, starting from the positive electrode 73, a hole injection layer 77 having a thickness of 50 nm and a light emitting layer 78 having a thickness of 50 nm are formed. Further, a first negative electrode layer 79*a* made of Ca having a thickness of 100 nm and a second negative electrode layer 79*b* made of Al having a thickness of 200 nm are successively formed to cover the upper surfaces of the light emitting layers 78, the inner surfaces of the holes 76, and the outer surfaces of the banks 75. Furthermore, a glass cover 64 having a thickness of about 1 mm is provided on the negative electrode layers via inert gas such as nitrogen gas 80. In this manner, the light emitting parts 63 of the organic EL light emitting element array 61 are formed. Light emission of the light emitting parts 63 is carried out on the glass substrate 62 side.

Regarding materials used to form the light emitting layer 78 and the hole injection layer 77, it is possible to use various publicly known materials, for example, those disclosed in Japanese Patent Unexamined Publications No. H10-12377 and No. 2000-323276. Detailed description thereof is omitted herein.

Figure 8:
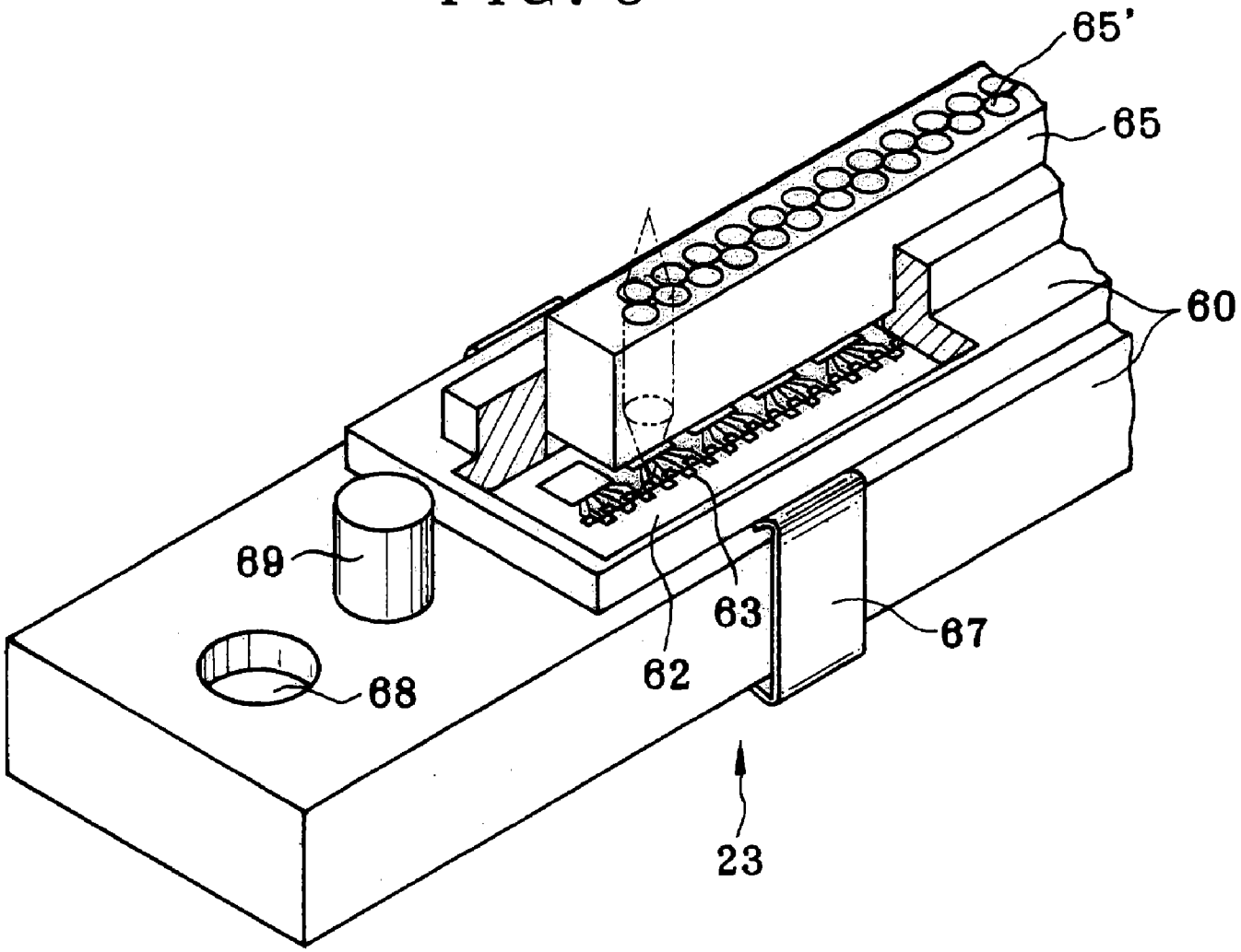
FIG. 8 is a perspective view showing an example of a mechanism for accurately positioning the image writing means relative to the image carrier attached to the image carrier unit.

FIG. 8 shows an example of a mechanism for positioning the image writing means 23 relative to the image carrier (photosensitive drum) 20 attached to the image carrier unit 25. The image carrier 20 is rotatably attached to the casing 50 of the image carrier unit 25 by its shaft. On the other hand, the organic EL light emitting element array 61 is held in the housing 60 having a long rectangular shape as shown in FIG. 6. Positioning pins 69 which are disposed on both end portions of the long housing 60 are fitted in corresponding positioning holes of the casing 50. Then, fixing screws are screwed into the screw holes of the casing 50 through holes 68 formed in the both end portions of the long housing 60, thereby fixing the long housing 60. In this manner, the image writing means 23 are fixed at the predetermined positions, respectively.

As shown in FIG. 2 and FIG. 3, when the developing means 24 are detached from the image carrier unit 25 to expose the image carrier unit 25 to outside light for the purpose of replacement of the expendable supplies or process for removing a jammed paper, ultraviolet rays from fluorescent lights and/or sunlight enter into the casing 50 through the openings 51 of the image carrier unit 25. Since the shielding portions 52 of the casing 50 remain between the openings 51 and the image writing means 23, the ultraviolet rays are prevented from being directly incident on the exposing positions and reflected at the image carriers 20 and thus prevented from reaching the light emitting parts 63 of the organic EL light emitting array 61 in the image writing means 23 via the gradient index type rod lens array 65. In addition, ultraviolet rays entering through openings on the side of the casing 50 confronting the intermediate transfer belt 16 are shielded by the charging means 22 and the shielding portions 53 of the casing 50 between the charging means 22 and the image writing means 23, thereby also preventing the ultraviolet rays from reaching the light emitting parts 63. By applying black paint, capable of absorbing ultraviolet rays, on the inner surfaces of the casing 50, the aforementioned action of shielding ultraviolet rays can be ensured.

On the other hand, since the housing 60 of the image writing means 23 is opaque and the back of the housing 60 is covered by the opaque cover 66, ultraviolet rays from fluorescent lights and/or sunlight being incident on the back of the organic EL light emitting element arrays 61 are prevented from reaching the light emitting parts 63 of the organic EL light emitting element arrays 61. Therefore, even when the image carrier unit 25 is exposed to ultraviolet rays for the purpose of replacing the expendable supplies or removing a jammed paper, ultraviolet rays are prevented from reaching the light emitting parts 63 of the organic EL light emitting element arrays 61 in the image writing means 23 which are united into the image carrier unit 25, thereby preventing the organic EL light emitting elements from being deteriorated due to ultraviolet rays.

Figure 9:
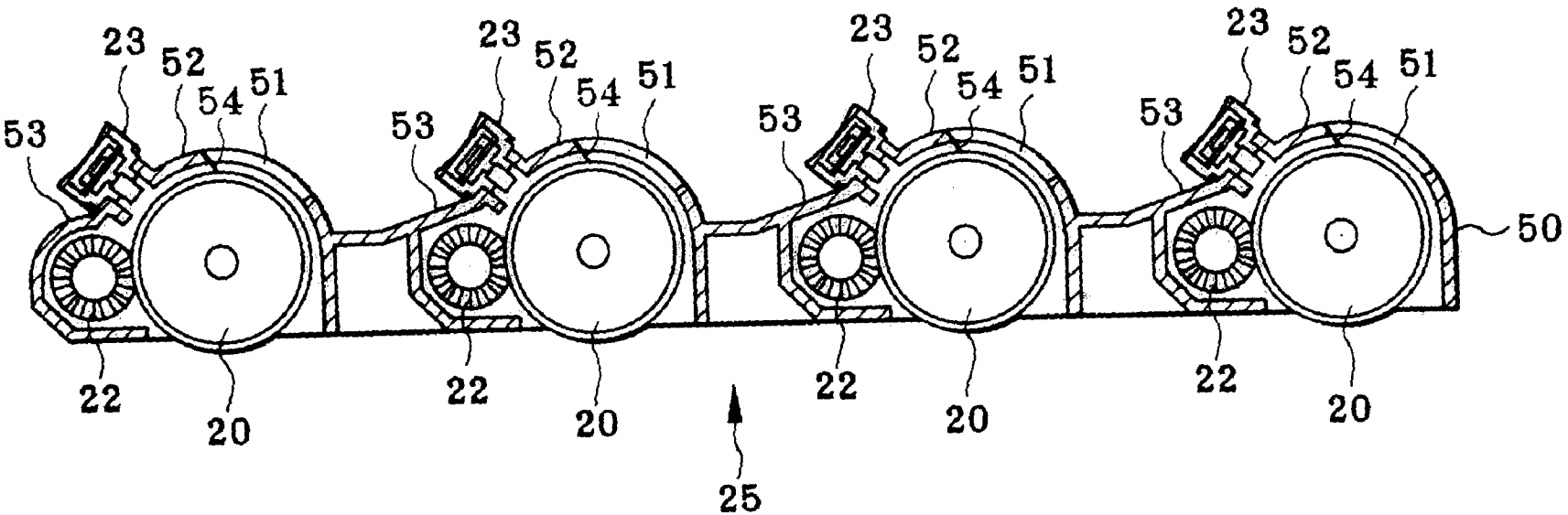
FIG. 9 is a sectional view similar to FIG. 5, but showing a variation example of the embodiment of FIG. 4 through FIG. 8.

FIG. 9 is a sectional view similar to FIG. 5, but showing a variation example of the embodiment of FIG. 4 through FIG. 8. This variation example is different from the embodiment of FIG. 5 by shielding films 54 each of which is disposed at an edge of each opening 51 on the image writing means 23 side. Without the shielding film 54, ultraviolet rays may enter through a space between the edge of the opening 51 on the image writing means 23 and the image carrier 20 due to multiple reflection so as to reach the light emitting parts 63 of the organic EL light emitting element array 61. With the shielding opening 51, however, ultraviolet rays are completely prevented from reaching the light emitting parts 63 of the organic EL light emitting element array 61 in the image writing means 23. Other structures are the same as those of the embodiment of FIG. 4 through FIG. 8.

By the way, the shielding portions 52, 53 are arranged on the both sides of the image writing means 23 and the back of the organic EL light emitting array 61 is shielded by the opaque cover 66 as mentioned above, the image carrier unit 25 is well closed. When the gradient index type rod lens array 65 covering the front of the organic EL light emitting element array 61 is contaminated, it is required to detach the gradient index type rod lens array 65 from the image carrier unit 25 to clean the gradient index type rod lens array 65. However, it is no easy task because the image carrier unit 25 is well closed.

Figure 10:
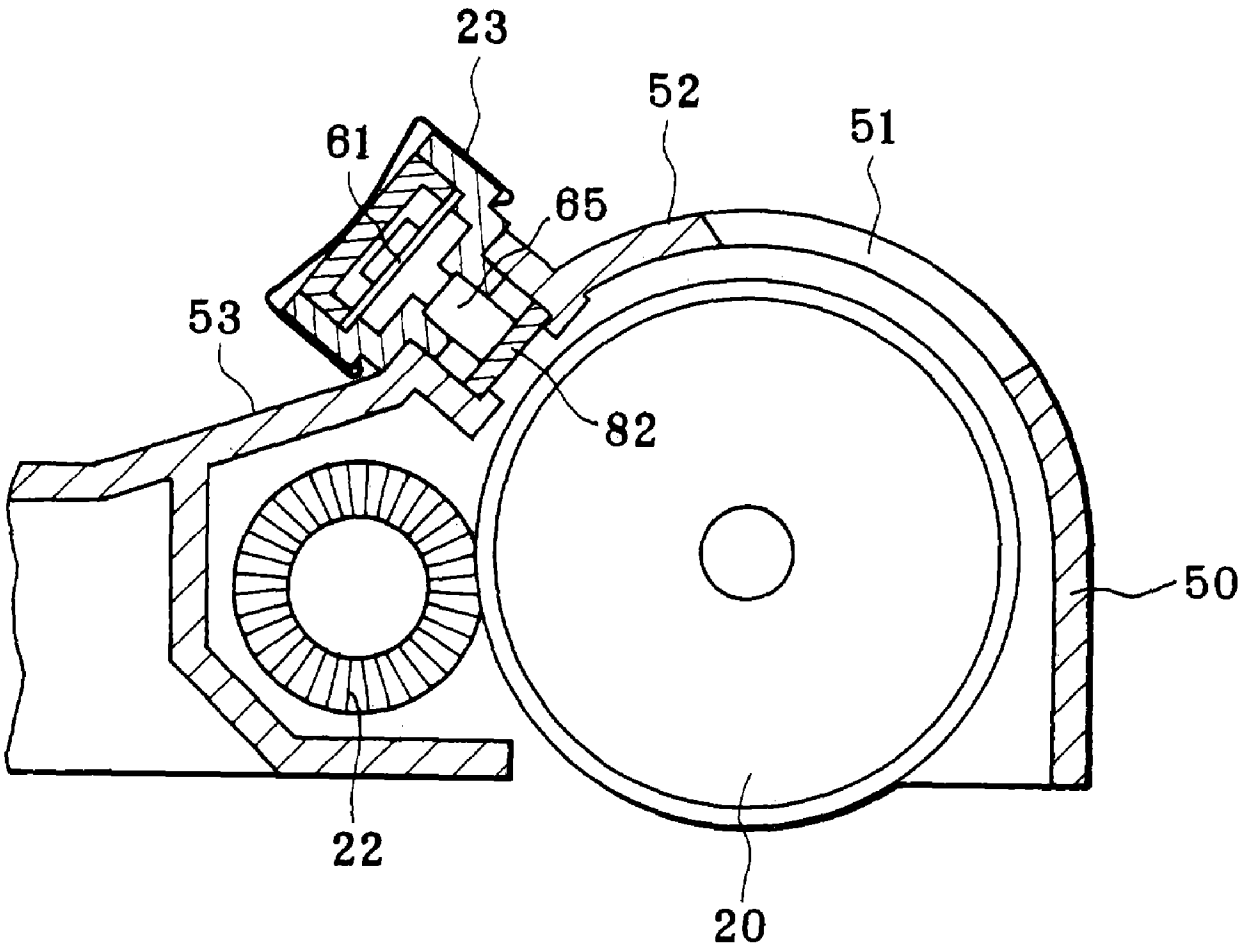
FIG. 10 is a sectional view of a portion corresponding to one image carrier of an image carrier unit of another variation example.
Figure 11:
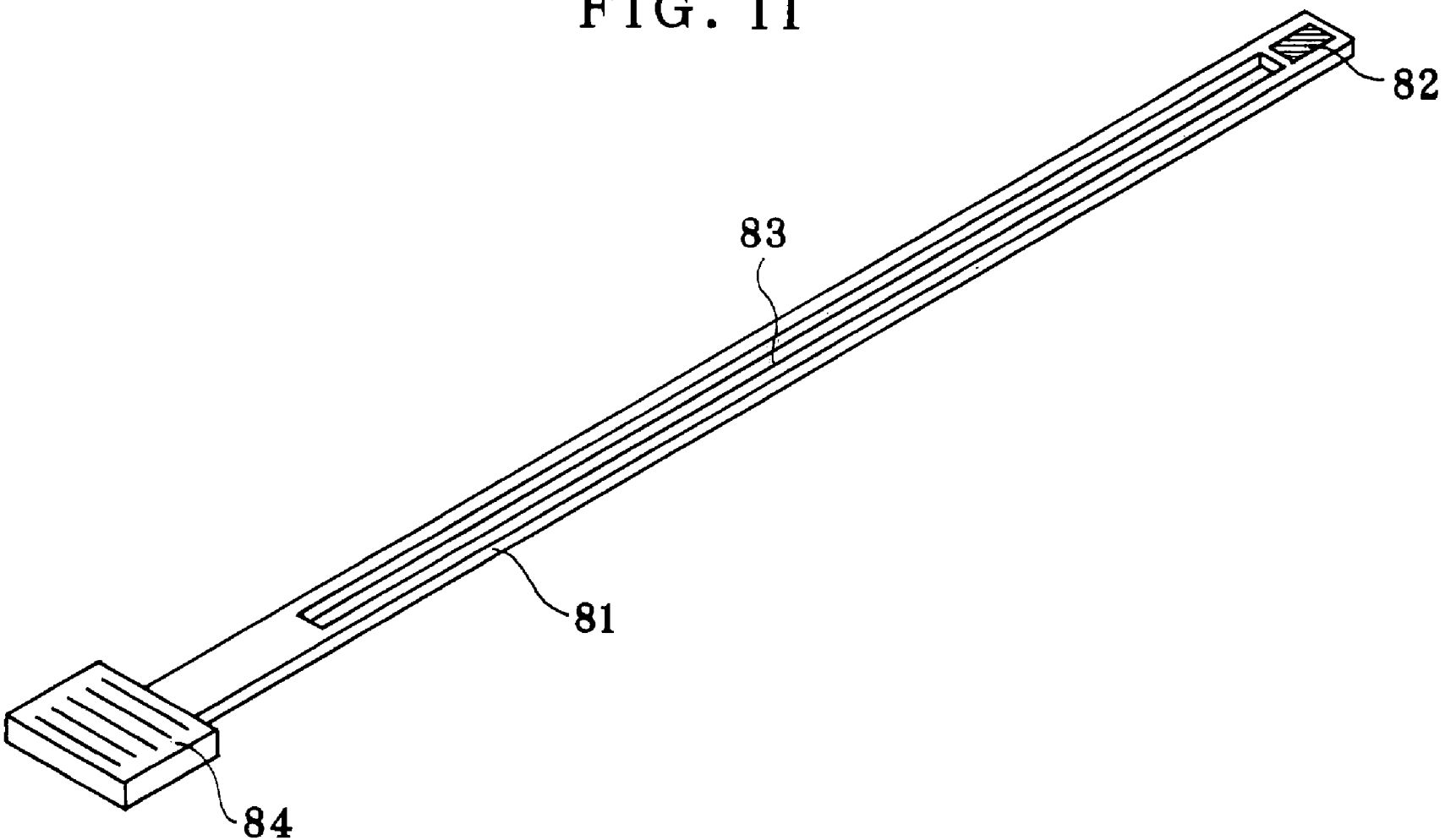
FIG. 11 is a perspective view of a cleaning member to be mounted on the portion shown in FIG. 10.
Figure 12:
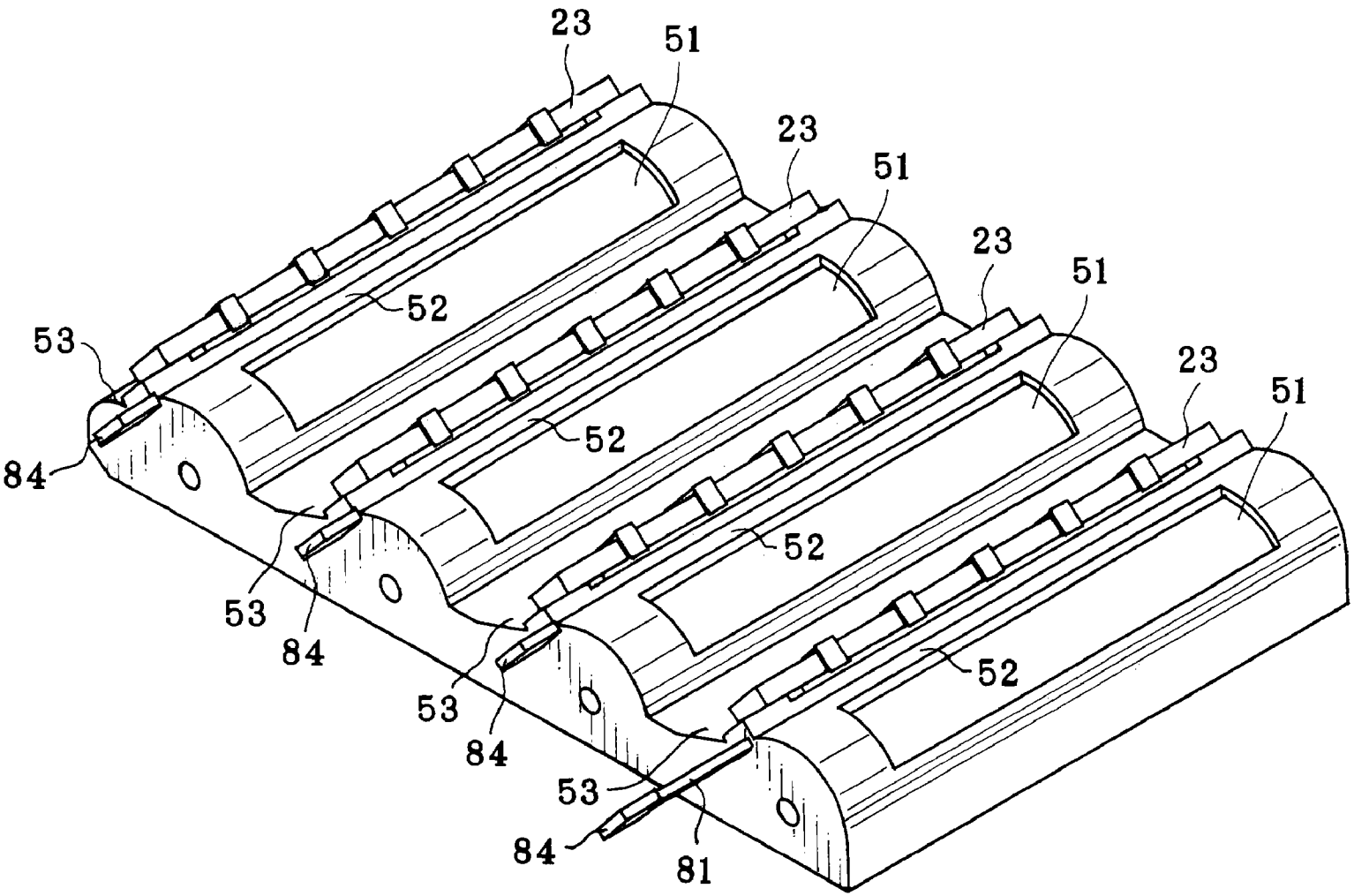
FIG. 12 is a perspective view similar to FIG. 4, but showing a variation example of FIG. 10.

Therefore, it is preferable to provide a cleaning means for cleaning the tip of the gradient index type rod lens array 65 without exploding the image carrier unit 25. Some examples are shown in FIG. 10 through FIG. 12. FIG. 10 is a sectional view showing a portion corresponding to one of the image carriers 20 of the image carrier unit 25, FIG. 11 is a perspective view showing a cleaning member to be disposed to the portion, and FIG. 12 is a perspective view similar to FIG. 4, but showing a variation example of the example shown in FIGS. 10 and 11.

FIG. 10 is a sectional view partially showing a portion near the image carrier 20 shown in FIG. 1. The image carrier unit 25 comprises the casing 50 made of an opaque metallic plate or the like and having openings on a side confronting the intermediate transfer belt 16. In the casing 50, four image carriers (photosensitive drums) 20 of the image forming stations Y, M, C, and K are rotatably supported parallel to each other at certain intervals, conductive brush rollers as the charging means 22 are supported such that each charging means 22 rotates with being in contact with a predetermined position of each image carrier 20, organic EL array exposure heads as the image writing means 23 are positioned relative to the image carriers 20 and parallel to the image carriers 20 on downstream side than the charging means 22.

Openings 51 are formed in the wall of the casing 50 on downstream side than the image writing means 23 so as to allow the developing rollers 33 of the developing means 24 to be in contact with the image carriers 20, respectively. Between each opening 51 and each image writing means 23, a shielding portion 52 of the casing 50 remains. Between each charging means 22 and each image writing means 23, a shielding portion 53 of the casing 50 remains. The shielding portions 52, 53, particularly the shielding portion 52 between the opening 51 and the image writing means 23, prevent ultraviolet rays from reaching the light emitting parts made of organic EL material from outside. Numeral 82 designates a cleaning pad which wipes the gradient index type rod lens array 65 covering the front of the organic EL light emitting element array 61 when the gradient index type rod lens array 65 is contaminated.

Near the end face of each gradient index type rod lens array 65 corresponding to each image forming station, a cleaning member 81 as shown in FIG. 11 is disposed. The cleaning member 81 is made of a long plate member having a length slightly longer than the longitudinal length of the image carrier 20. The cleaning member 81 is provided at an end thereof with the cleaning pad 82 and at the other end thereof with a pull 84. Between the cleaning pad 82 and the pull 84, the cleaning member 81 is also provided along the center with a long opening 83 having such a configuration as to correspond to the end face of the gradient index rod lens array 65. The cleaning member 81 is attached to the casing 50 of the image carrier unit 25 at a position corresponding the end face of the gradient index type rod lens array 65 of each image writing means 23 in such a manner that the cleaning member 81 is slidable along the longitudinal direction. As the cleaning member 81 is withdrawn by pulling the pull 84, the cleaning pad 82 disposed on the end wipes the end face of the gradient index type rod lens array 65 from one end to the other end so as to remove the contamination on the end face. As the cleaning member 81 is returned to the inside of the casing 50 by pressing the pull 84, the cleaning pad 82 wipes again the end face of the gradient index type rod lens array 65 in the opposite direction and is finally deviate from the end face of the gradient index type rod lens array 65 so that the opening 83 of the cleaning member 81 faces the end face of the gradient index type rod lens array 65. Since exposure is conducted in this state, the cleaning member 81 is not in the way of the exposure.

As another variation example, a window member for cutting out ultraviolet rays is fitted in the opening 83 of the cleaning member 81. In this case, the cleaning pad 82 is mounted on the casing 50 side. As the image carrier unit 25 is exposed to outside light for the purpose of replacing the expendable supplies or removing a jammed paper in a state that the cleaning member 81 is pressed into the casing 50, ultraviolet rays entering through the opening 51 of the image carrier unit 25 is shielded by the window member in the opening 83 of the cleaning member 81 and is thus prevented from reaching the light emitting parts 63 of the organic EL light emitting element array 61. In this case, the shielding portions 52, 53 may be omitted, but the opaque housing 60 and the opaque cover 66 of the image writing means 23 are necessary just like the embodiment shown in FIGS. 4 through 8. In the aforementioned structure, as the cleaning member 81 is withdrawn from the casing 50 and is returned to the inside of the casing 50, the window member in the opening 83 slides relative to the cleaning pad 82 mounted on the casing 50 side with touching the cleaning pad 82, thereby easily cleaning the window member.

As further another variation example different from the structure of FIG. 10 through FIG. 12, a film for cutting out ultraviolet rays may be attached to the end face of each gradient index type rod lens array 65. Accordingly, ultraviolet rays entering through the opening 51 of the image carrier unit 25 is shielded by the film for cutting out ultraviolet rays so that the ultraviolet rays are prevented from reaching the light emitting parts 63 of the organic EL light emitting element array 61 in the image writing means 23. Also in this case, the shielding portions 52, 53 may be omitted, but the opaque housing 60 and the opaque cover 66 of the image writing means 23 are necessary just like the embodiment shown in FIGS. 4 through 8.

Figure 13:
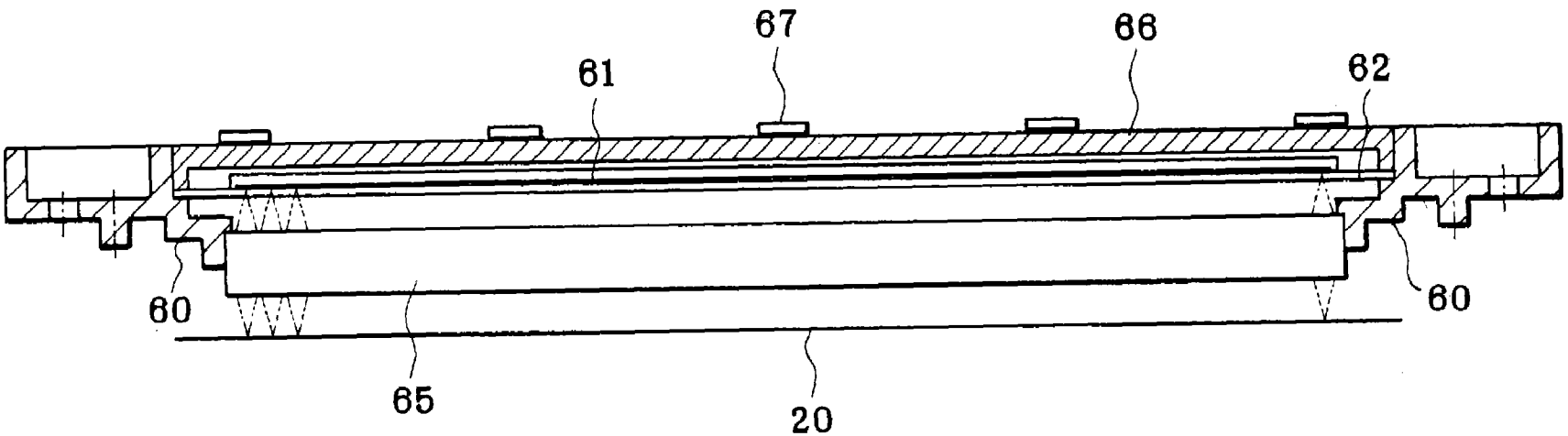
FIG. 13 is a schematic sectional view showing an exposure head according to the present invention in the main scanning direction.

FIG. 13 is a sectional view of the image writing means 23 in the main scanning direction. As shown in FIG. 13, light beams outputted from the light emitting parts of the organic EL light emitting element array 61 pass through the glass substrate 62 and are thus incident on the image carrier 20. The glass substrate 62 has plane surfaces substantially parallel to each other. One of the surfaces is a surface on which the light emitting parts are formed and the other is a surface from which light beams are projected. The housing 60 shown in FIG. 6 is structured to cover the glass substrate 62 also in the main scanning direction in addition to the sub scanning direction. A black paint is also applied to the faces confronting the both end faces of the glass substrate 62 in the main scanning direction. As mentioned above, the faces of the housing 60 confronting the four end faces of the glass substrate 62 are black painted members. Accordingly, since the housing 60 has light absorbing property relative to light beams of all wavelengths, the housing 60 can absorb light regardless of the wavelength of light emitted by the organic EL light emitting elements.

In the present invention, the glass substrate 62 is covered by the housing 60 made of an opaque material and, in addition, the black paint having light absorbing property is applied to the faces confronting the four end faces of the glass substrate 62. Therefore, stray light beams are prevented from leaking outside the optical system through the glass substrate and re-incident of light beam onto the glass substrate can be prevented. Accordingly, even when TFTs are formed on the glass substrate, light beam is prevented from being incident on the TFT again so that the condition of driving the EL light emitting element never be changed, thereby preventing the light emitting amount from being unsettled. In addition, it is possible to provide an image forming apparatus without image quality deterioration. The housing 60 of the present invention has absorptance of light larger than that of the glass substrate 62 and equal to or less than a predetermined value, e.g. 0.5. In this case, the leakage of stray light can be prevented and the re-incident of light onto the glass substrate 62 can be prevented.

Figure 14:
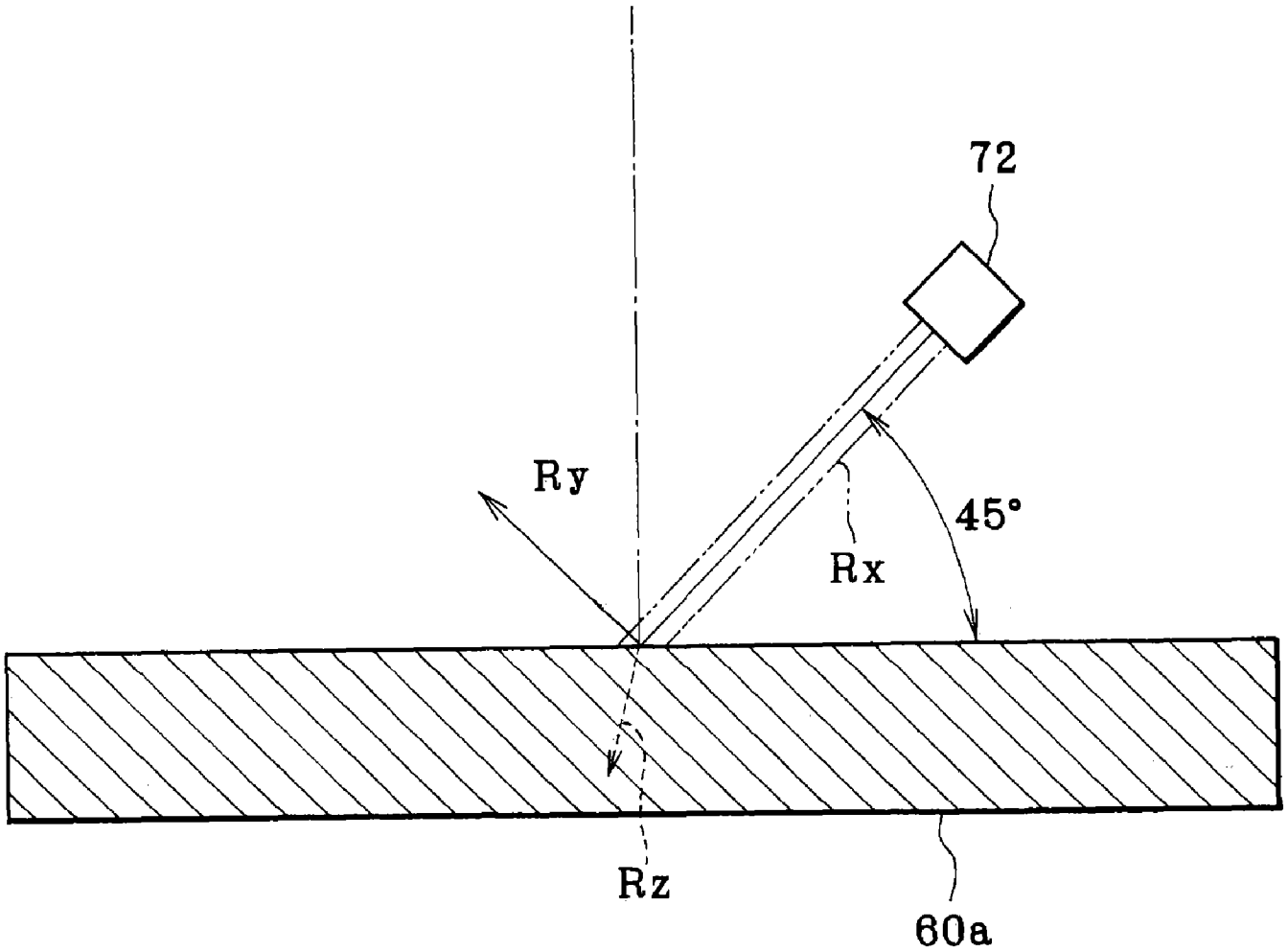
FIG. 14 is an illustration for explaining an example of measuring the light absorbing characteristic of a light absorbing member.
Figure 15:
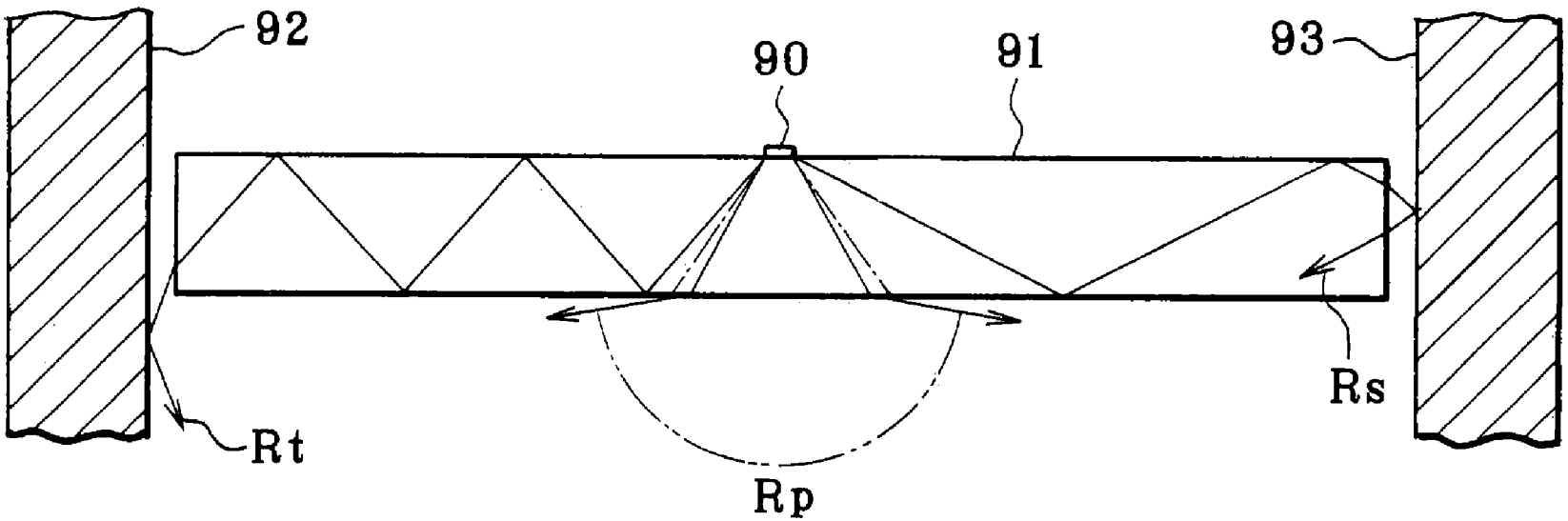
FIG. 15 is an explanatory illustration showing a course example of light beams emitted from the organic EL light emitting element.

FIG. 14 is an illustration for explaining an example of measuring the light absorption characteristic of a member to be used in the housing 60. In FIG. 14, from a light source 72 of which a wavelength is contained in a light emitting wave distribution of organic EL used in the present invention, parallel light beams Rx are incident on a test piece 60*a* of the aforementioned member at an angle of 45 degree. From the reflecting light beams Ry, the total light reflectance is measured. The light emitting amount of the light source 72 is also measured separately. From the relation between the light emitting amount and the total light reflectance, the light amount of the light beams Rz absorbed by the test piece 60*a* can be calculated. The ratio between the absorbed light amount and the light emitting amount is the absorptance of light of the test piece 60*a*. The total light reflectance of the test piece 60*a* is measured by the method defined according to JIS K7105 "Testing Methods for Optical Properties of Plastics" or a similar method.

While the image carrier cartridge and the exposure head of the present invention, and the image forming apparatus using these have been described with reference to some embodiments, the present invention is not limited to these embodiments and various changes and modifications may be made.

As apparent from the aforementioned description, according to an image carrier cartridge and an exposure head of the present invention and an image forming apparatus using these, an organic EL light emitting element array and an imaging optical system disposed in front of the organic EL light emitting element array are provided as the exposure means and a light shielding member for shielding ultraviolet rays is provided to enclose the exposure means. Therefore, even when the image carrier cartridge is detached from the body of the image forming apparatus for the purpose of replacement of the expendable supplies or process for removing a jammed paper so that the image carrier cartridge is exposed to ultraviolet rays from fluorescent lights and/or sunlight, the shielding member can prevents the ultraviolet rays from reaching the light emitting parts of the organic EL light emitting element array, thereby preventing the organic EL light emitting element from being deteriorated due to the ultraviolet rays.

Further, according to an exposure head of the present invention, the leakage of stray light from a glass substrate to the outside of the optical system can be prevented and light once projected through end faces of the glass substrate can be prevented from being incident on the glass substrate again. Therefore, an image forming apparatus employing the exposure head can form high quality images without quality deterioration.

We claim:

1. An image carrier cartridge comprising:

at least one image carrier rotatably supported; and exposure means disposed at an exposure position for said image carrier, wherein said image carrier cartridge is designed to be detachable relative to the body of an image forming apparatus, and wherein said exposure means comprises an organic EL light emitting element array and an imaging optical system disposed in front of the organic EL light emitting element array, and a light shielding member for shielding at least ultraviolet rays is provided around said exposure means.

2. An image carrier cartridge as claimed in claim 1, wherein said light shielding member has a first light shielding member disposed to cover said organic EL light emitting element array.

3. An image carrier cartridge as claimed in claim 1, wherein said light shielding member has a second light shielding member disposed to cover a part of said image carrier near said exposure means so as to prevent ultraviolet rays from being incident on the exposure position of said image carrier.

4. An image carrier cartridge as claimed in claim 3, wherein a developing means to be disposed at a developing position for said image carrier is detachable relative to the image carrier cartridge, and said second light shielding member is disposed between a position, where said developing means is allowed to be in contact with said image carrier, and said exposure means.

5. An image carrier cartridge as claimed in claim 1, wherein a cleaning means is provided for cleaning a face, confronting said image carrier, of said imaging optical system.

6. An image carrier cartridge as claimed in claim 1, wherein an ultraviolet cutting member for cutting out ultraviolet rays is provided on or near the face, confronting said image carrier, of said imaging optical system.

7. An image carrier cartridge as claimed in claim 6, wherein said ultraviolet cutting member is provided on a sliding member which is slidable along the face, confronting said image carrier, of said imaging optical system and a cleaning member is provided in such a manner as to touch said ultraviolet cutting member during sliding operation.

8. An image carrier cartridge as claimed in any one of claims 1 through 7, wherein said image carder cartridge comprises a plurality of said image carriers and a plurality of said exposure means corresponding to the respective image carriers.

9. An image forming apparatus employing an image carrier cartridge as claimed in any one of claims 1 through 7, and comprising a charging means, an exposure means, a developing means, and a transfer means which are arranged around said image carrier, wherein said image forming apparatus transfers a toner image formed on said image carrier onto a transfer medium.

10. The image carrier cartridge according to claim 1, wherein an image carrier from the at least one image carrier and the exposure means are integrally formed.

11. The image carrier cartridge according to claim 11, wherein the at least one image carrier and the exposure means are positioned in the image carrier cartridge.

12. An exposure head to be disposed at an exposure position for an image carrier, said exposure head comprising at least a transparent substrate, an organic EL light emitting element array having light emitting parts formed on said transparent substrate and aligned in lines, and an imaging optical system disposed in front of said organic EL light emitting element array, wherein light beams outputted from said light emitting parts pass through said transparent substrate and are projected toward said image carrier, said transparent substrate has surfaces being in parallel to each other, one of the surfaces being a surface on which said light emitting parts are formed and the other being a surface from which said light beams are projected, a member covering said transparent substrate is an opaque member, and all of faces of said opaque member confronting the end faces of said transparent substrate are composed of light absorbing members.

13. An exposure head as claimed in claim 12, wherein the light absorbance of said light absorbing member is set to be larger than the light absorbance of said transparent substrate and to be not larger than 0.5.

14. An exposure head as claimed in claim 12, wherein said light absorbing member is black.

15. An exposure head as claimed in claim 12, wherein said transparent substrate is optically sealed by said opaque member.

16. An exposure head as claimed in claim 12, wherein TFTs for driving said light emitting pans are formed on said transparent substrate.

17. An image forming apparatus employing an image carrier cartridge to which an exposure head as claimed in any one of claims 12 through 16 is attached, and comprising a charging means, the exposure means, a developing means, and a transfer means which are arranged around the image carrier, wherein said image forming apparatus transfers a toner image formed on said image carrier onto a transfer medium.

18. The image carrier cartridge according to claim 11, wherein the image carrier cartridge with the at least one image carrier and the exposure means is designed to detach from the body of the image forming apparatus.

* * * * *